US011072959B2

(12) United States Patent
Stuke et al.

(10) Patent No.: US 11,072,959 B2
(45) Date of Patent: Jul. 27, 2021

(54) HINGE AND METHOD FOR OPENING AND CLOSING A HINGE

(71) Applicant: Hettich-ONI GmbH & Co. KG, Vlotho (DE)

(72) Inventors: Kai Michael Stuke, Bielefeld (DE); Mark Schneider, Porta Westfalica (DE); Jens Poischbeg, Leopoldshoehe (DE); Karsten Filges, Bielefeld (DE); Alexander Heinz, Osnabrueck (DE)

(73) Assignee: Hettich-ONI GmbH & Co. KG, Vlotho (DE)

( * ) Notice: Subject to any disclaimer, the term of this patent is extended or adjusted under 35 U.S.C. 154(b) by 0 days.

(21) Appl. No.: 16/624,058

(22) PCT Filed: Jun. 13, 2018

(86) PCT No.: PCT/EP2018/065604
§ 371 (c)(1),
(2) Date: Dec. 18, 2019

(87) PCT Pub. No.: WO2019/001957
PCT Pub. Date: Jan. 3, 2019

(65) Prior Publication Data

US 2020/0149335 A1 May 14, 2020

(30) Foreign Application Priority Data

Jun. 29, 2017 (DE) ..... 10 2017 114 473.0

(51) Int. Cl.
*E05F 1/08* (2006.01)
*E05F 5/00* (2017.01)
(Continued)

(52) U.S. Cl.
CPC ..... *E05F 5/006* (2013.01); *E05D 3/142* (2013.01); *E05D 11/1021* (2013.01);
(Continued)

(58) Field of Classification Search
CPC ..... E05Y 2900/20; E05Y 2900/202; E05Y 2900/204; E05Y 2900/208; E05Y 2201/20;
(Continued)

(56) References Cited

U.S. PATENT DOCUMENTS 5,029,362 A * 7/1991 Prodan ..... E05D 3/142 16/236
8,205,298 B2 * 6/2012 Lin ..... E05F 5/006 16/287
(Continued)

FOREIGN PATENT DOCUMENTS

CN 103726730 A 4/2014
CN 203640462 U 6/2014
(Continued)

OTHER PUBLICATIONS

International Search Report of PCT/EP2018/065604, dated Sep. 14, 2018.
(Continued)

*Primary Examiner* — Chuck Y Mah
(74) *Attorney, Agent, or Firm* — Collard & Roe, P.C.

(57) ABSTRACT

A hinge has a side part fixable on a wall and a hinge part, which is pivotable in relation to the side part and is fixable on a door. Two levers are provided on the side part and the hinge part, which are each rotatably mounted on the side part and on the hinge part, and a linear damper having a housing and a piston rod is arranged in the side part.

18 Claims, 8 Drawing Sheets

(51) Int. Cl.
*E05D 3/14* (2006.01)
*E05D 11/10* (2006.01)

(52) U.S. Cl.
CPC ..... *E05Y 2201/21* (2013.01); *E05Y 2201/256* (2013.01); *E05Y 2201/264* (2013.01); *E05Y 2900/20* (2013.01)

(58) Field of Classification Search
CPC ..... E05Y 2201/21; E05Y 2201/261; E05F 5/006; E05F 5/02; E05F 5/027; E05D 11/1021; E05D 11/1042; E05D 11/105; E05D 11/1064; E05D 7/04; E05D 7/0407; E05D 7/125; E05D 3/142; Y10T 16/5383; Y10T 16/304; Y10T 16/54029
See application file for complete search history.

(56) References Cited

U.S. PATENT DOCUMENTS

| | | | | |
|---|---|---|---|---|
| 8,561,259 | B2 * | 10/2013 | Liao | E05D 3/142 16/54 |
| 8,601,644 | B1 * | 12/2013 | Chen | E05F 5/006 16/286 |
| 9,617,773 | B2 * | 4/2017 | Cooper | E05D 3/14 |
| 9,739,081 | B2 * | 8/2017 | Stuke | E05F 5/006 |
| 9,840,864 | B2 * | 12/2017 | Chen | E05F 5/10 |
| 10,081,975 | B2 * | 9/2018 | Cooper | E05F 5/02 |
| 10,214,951 | B2 * | 2/2019 | Liang | E05F 5/00 |
| 2005/0248246 | A1 * | 11/2005 | Ger | E05F 5/006 312/334.47 |
| 2011/0083299 | A1 * | 4/2011 | Krudener | E05D 7/0407 16/319 |
| 2013/0239363 | A1 * | 9/2013 | Apur | E05F 5/006 16/50 |
| 2015/0330128 | A1 * | 11/2015 | Ng | E05D 7/0407 16/65 |
| 2017/0138106 | A1 * | 5/2017 | Stuke | E05F 1/14 |
| 2018/0171690 | A1 * | 6/2018 | Rodriguez Rodriguez | E05D 7/0423 |
| 2018/0216385 | A1 * | 8/2018 | Rodriguez Rodriguez | E05D 3/142 |

FOREIGN PATENT DOCUMENTS

| | | | | |
|---|---|---|---|---|
| DE | 2818735 | A1 * | 11/1979 | E05D 5/0276 |
| DE | 202006003196 | U1 | 7/2007 | |
| DE | 202006013356 | U1 | 1/2008 | |
| DE | 102007031175 | B3 | 10/2008 | |
| DE | 102011050053 | A1 * | 11/2012 | E05F 5/006 |
| EP | 2057337 | B1 * | 9/2018 | E05F 5/006 |
| JP | 2010209638 | A * | 9/2010 | |
| SU | 741806 | A3 * | 6/1980 | E05D 11/1021 |
| WO | 2008011955 | A1 | 1/2008 | |

OTHER PUBLICATIONS

German Search Report dated Feb. 28, 2018 (with English translation of relevant parts (issued in the corresponding German application 10 2017 114 473.0)).

International Search Report of PCT/EP2018/065603, dated Sep. 18, 2018.

German Search Report dated Feb. 23, 2018 (with English translation of relevant parts (issued in German application 10 2017 114 477.3 (PCT/EP2018/065603)).

* cited by examiner

HINGE AND METHOD FOR OPENING AND CLOSING A HINGE

CROSS REFERENCE TO RELATED APPLICATIONS

This application is the National Stage of PCT/EP2018/065604 filed on Jun. 13, 2018, which claims priority under 35 U.S.C. § 119 of German Application No. 10 2017 114 473.0 filed on Jun. 29, 2017, the disclosures of which are incorporated by reference. The international application under PCT article 21(2) was not published in English.

BACKGROUND OF THE INVENTION

The present invention relates to a hinge having a side part fixable on a wall and a hinge part, which is pivotable in relation to the side part and is fixable on a door, wherein two levers are provided on the side part and the hinge part, which are each rotatably mounted on the side part and on the hinge part, and a linear damper arranged in the side part having a housing and a piston rod.

DE 20 2006 003 196 U discloses a furniture hinge, in which a hinge part is pivotably mounted on a side part via a support lever and a guide lever. A cantilever is formed on the guide lever, on which cantilever a linear damper having a housing and a piston rod displaceable in relation to the housing is pivotably mounted. Such a linear damper is well suitable for damping a closing movement, but the problem results that the required installation space in the side part is large due to the pivoting of the linear damper.

SUMMARY OF THE INVENTION

It is therefore the object of the present invention to provide a hinge which has optimized damping behavior and a small installation space.

This object is achieved by a hinge having having a side part fixable on a wall and a hinge part, which is pivotable in relation to the side part and is fixable on a door. Two levers, which are each rotatably mounted on the side part and on the hinge part, are provided between the side part and the hinge part/A linear damper is arranged in the side part and has a housing and a piston rod.

In the hinge according to the invention, a control curve is formed on one of the levers, which compresses the linear damper during a closing movement, wherein the housing of the linear damper is fixed immovably in the side part and the piston rod is movable by the control curve. A particularly compact construction thus results, since the housing is immovably fixed and only the piston rod is moved during a pivot of the hinge part.

In a further hinge according to the invention, a control curve is formed on one of the levers for pivoting the hinge part, which compresses the linear damper during a closing movement shortly before reaching a closed position and during an opening movement shortly before reaching the maximally open position. Due to the use of such a control curve, the damping behavior of the linear damper can be optimally adapted to the opening and closing behavior, wherein the level of the damping forces during an opening or closing movement can be freely selected by the contour of the control curve. The damping forces occurring during a closing movement can be embodied as significantly greater than during an opening movement, wherein optionally the opening damping can also take place with the same forces or greater forces. Moreover, the hinge is compactly constructed, since the linear damper is arranged in the side part and is affected via the control curve of a lever.

The linear damper preferably has its greatest extension in the longitudinal direction in an angle range between 30 and 110°, preferably 35° to 80°, before the closed position. The closed position in this case is the position which is predetermined by the hinge when a door is fastened thereon, which is then located in the closed position. During opening of the door, the hinge part is pivoted in relation to the side part up to the maximally open position of the door and/or the hinge part. The maximally open position can be, for example, in an angle range between 90° to 180°, in particular 105° to 140°.

For stable fixing of the linear damper, it can preferably be fixed on the side part via a holder. The housing of the linear damper can be fixed in a rotationally-fixed manner on the side part, in particular in the holder, in this case. For this purpose, the holder can comprise an opening into which a cup-shaped housing of the damper is inserted. The holder can be fixed on two axes of the hinge in this case, which are provided in any case for fixing the levers, so that no additional components are required for fixing the holder.

In an alternative embodiment, the damping housing and the holder can also be embodied in one piece, for example, as an injection-molded part made of plastic, so that the damper housing can be fixed directly on the side part.

In a further embodiment, the control curve is formed on at least one curved web, along which a pin slides, which acts on the linear damper. The pin is thus arranged between the linear damper and the control curve. In this case, the pin can be linearly guided on a holder or the side part to avoid lateral forces on the piston rod. For good guiding of the pin, the lever can be formed U-shaped and can form two control curves, against which the pin presses.

The control curve is preferably formed on the lever, which is arranged on the outside in relation to a pivot axis of the hinge part. A control curve can thus be formed in a simple manner which enables a maximum longitudinal extension of the linear damper in a middle opening angle range.

For optimum setting and positioning of a door on the hinge part, the side part is preferably held adjustably on an installation plate and a holding element, wherein a support adjustment unit and a depth adjustment unit are preferably provided on the side part. Moreover, a closing spring is preferably provided for pre-tensioning the hinge part in a closing region, to ensure reliable closing of a door held on the hinge part. The closing spring can be designed so that it generates a closing force before the damping effect of the damper begins during the closing of the door. Furthermore, a further spring can be provided for pre-tensioning the piston rod in an extended position of the damper. The closing spring acts during the closing damping phase against the spring of the piston rod, so that the spring which enables the extension of the piston rod is tensioned during the closing procedure.

In the method according to the invention, a linear damper experiences a maximum longitudinal extension during an opening movement up to the maximally open position, and also passes through it during a closing movement. The damper can thus provide damping forces both in the opening and also in the closing direction, wherein optionally no damping forces are also provided in the opening direction, since the linear damper is compressed in an idle stroke range. In the closing direction, a damping of the closing movement of the hinge part is performed in any case before reaching the closed position.

BRIEF DESCRIPTION OF THE DRAWING FIGURES

DETAILED DESCRIPTION OF THE EMBODIMENTS

Figure 1:
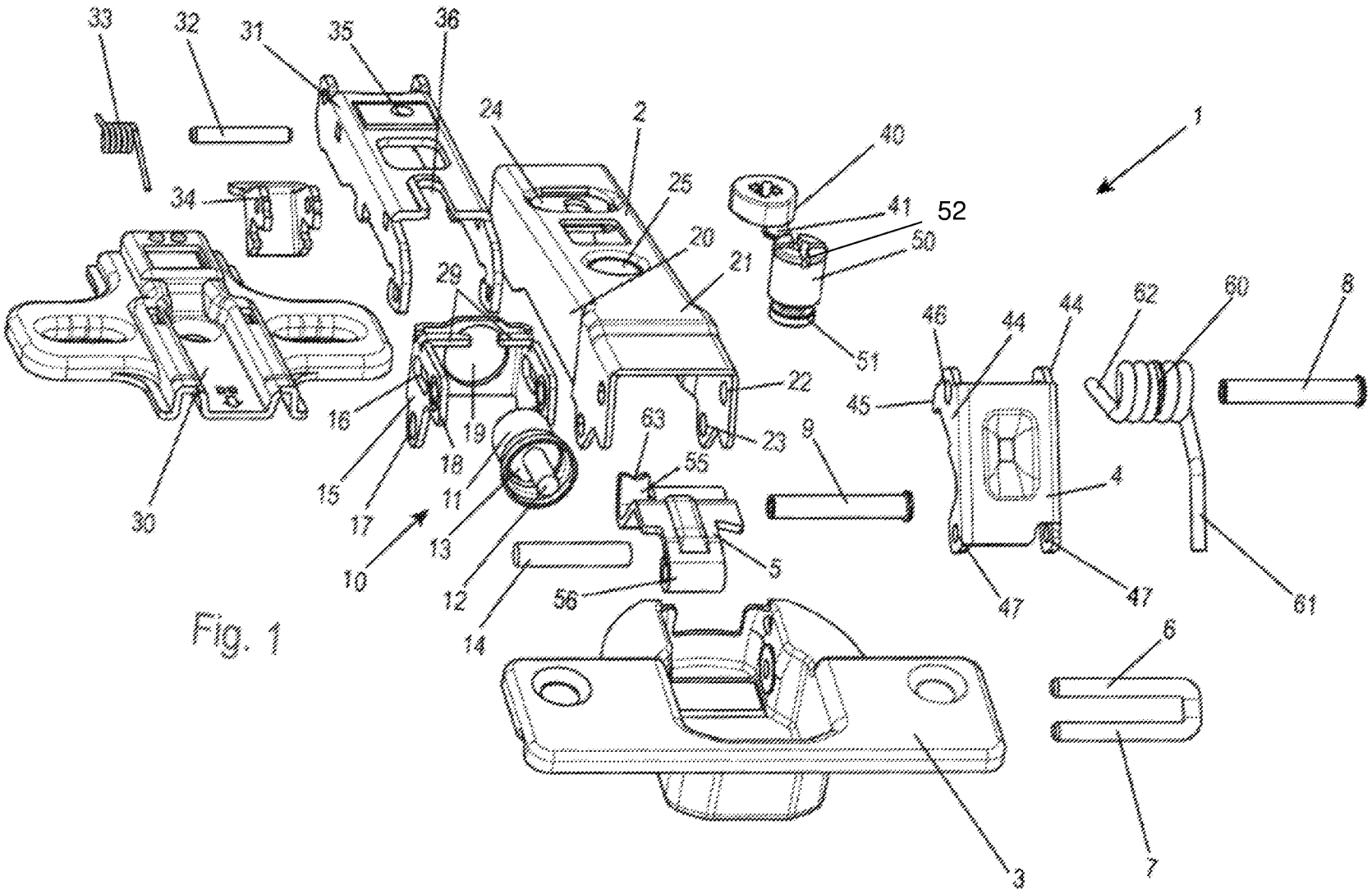
FIG. 1 shows a perspective exploded illustration of a hinge according to the invention.

A hinge 1, in particular for furniture or domestic appliances, comprises a side part 2, which is fixable on a side wall of a furniture body or on another wall. A hinge part 3 is pivotably mounted on the side part 2, on which hinge part a door can be fixed, which is pivotable via the hinge 1 from a closed position into an open position. For this purpose, two levers 4 and 5 are provided between the side part 2 and the hinge part 3. The lever 4 is formed U-shaped, wherein the lever 4 comprises lateral webs 44. The lever 4 comprises openings 47 on the webs 44 in this case, through which an axis 6 is inserted to mount the lever 4 rotatably on the hinge part 3. Furthermore, a spaced-apart axis 7 is also integrally formed with the axis 6, which is inserted through an eye 56 on the lever 5 to mount the lever 5 rotatably on the hinge part 3. The lever 5 can also consist of multiple individual flat parts, which result in a lever 5 having corresponding holes for the axes 7 and 9 when laid on one another.

The side part 2, which is formed U-shaped and comprises two legs 20 and a connecting web 21, has openings 22 on the legs 20, through which the axis 8 is inserted to mount the lever 4 rotatably on the side part 2. Furthermore, openings 23 are formed on the legs 20, through which an axis 9 is inserted to mount the lever 5 rotatably on the side part 2.

To damp a closing movement of the hinge part 3, a linear damper 10 is provided, which comprises a cup-shaped housing 11 and a piston rod 12 movable in relation to the housing 11. A piston 13 is fixed on the piston rod 12 to generate damping forces during a movement of the piston 13 in relation to the housing 11. The linear damper 10 has a compact construction, and the stroke movement of the piston rod 12 is preferably in a range between 2 mm and 6 mm, in particular 3 mm to 5 mm.

The linear damper 10 is fixed on a holder 15, which is arranged in the side part 2. The holder 15 is formed U-shaped and comprises an opening 19 on the connecting section, into which the housing 11 of the linear damper is inserted until an edge protruding radially outward on the housing 11 presses against the holder 15. Two tabs 29 are formed in this case on the holder, which delimit a movement of the housing 11 in the longitudinal direction of the piston rod 12. The holder 15 comprises openings 17 and 18 on the two legs, which are penetrated by the axes 8 and 9, which are inserted into the side part 2. The holder 15 and thus also the linear damper 10 are thus held in a rotationally-fixed manner in the side part 2. The holder 15 furthermore comprises an oblong hole 16, which is used for guiding a pin 14. The pin 14 presses against a frontal end of the piston rod 12 to compress the linear damper 10. The pin 14 can also be fixedly connected to the piston rod 12, so that a type of hammerhead for guiding the piston rod 12 in the oblong hole 16 is formed on the piston rod 12. Furthermore, a spring is provided in the linear damper 10 to pre-tension the piston rod 12 in a protruding position. The pin 14 is embodied as round in this exemplary embodiment. The pin 14 can also have other basic shapes, for example, rectangular or oval. Contact surfaces for the guide in the oblong hole 16 and/or contact surfaces as a contact or fastening surface for the piston rod 12 can be provided on the pin 14.

The side part 2 can optionally be fixed directly on a side wall of a body. In the illustrated exemplary embodiment, however, an installation plate 30 is fixed on the side wall, on which a holding element 31 is held, on which the side part 2 is held adjustably. The holding element 31 comprises a slotted opening 36 for a support adjustment unit 50 and an opening 35 for a depth adjustment unit 40. The depth adjustment unit 40 has an eccentric pin 41, which is guided through an aperture 24 on the side part 2 and engages in the opening 35. The support adjustment unit 50 has a guide groove 51, which is incorporated into the opening 36 on the holding element 31, and a thread 52, which is engaged by means of the threaded borehole 25 in the side part 2.

The holding element 31 is furthermore latched on the installation plate 30 via a catch element 34, which is rotatably mounted on the holding element 31 via an axis 32 and is moreover pre-tensioned via a spring 33.

The hinge 1 furthermore comprises a spring 60, which is formed as a leg spring and comprises a first spring arm 61, which is supported on the lever 4. A second opposing spring arm 62 is supported on the lever 5, wherein a receptacle 63 is formed on a web 55 for this purpose on the lever 5. Alternatively, other closing spring arrangements known in the prior art can also be used. Arrangements having a leaf spring can also be used, for example.

Figure 2:
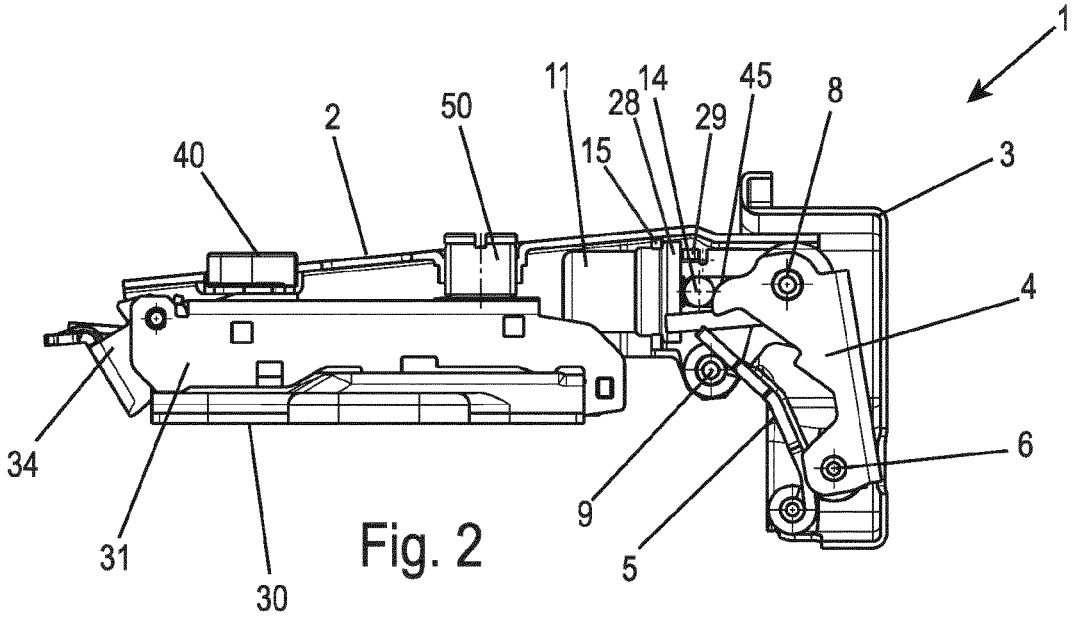
FIG. 2 shows a sectional side view of the hinge of FIG. 1 in a closed position.
Figure 3:
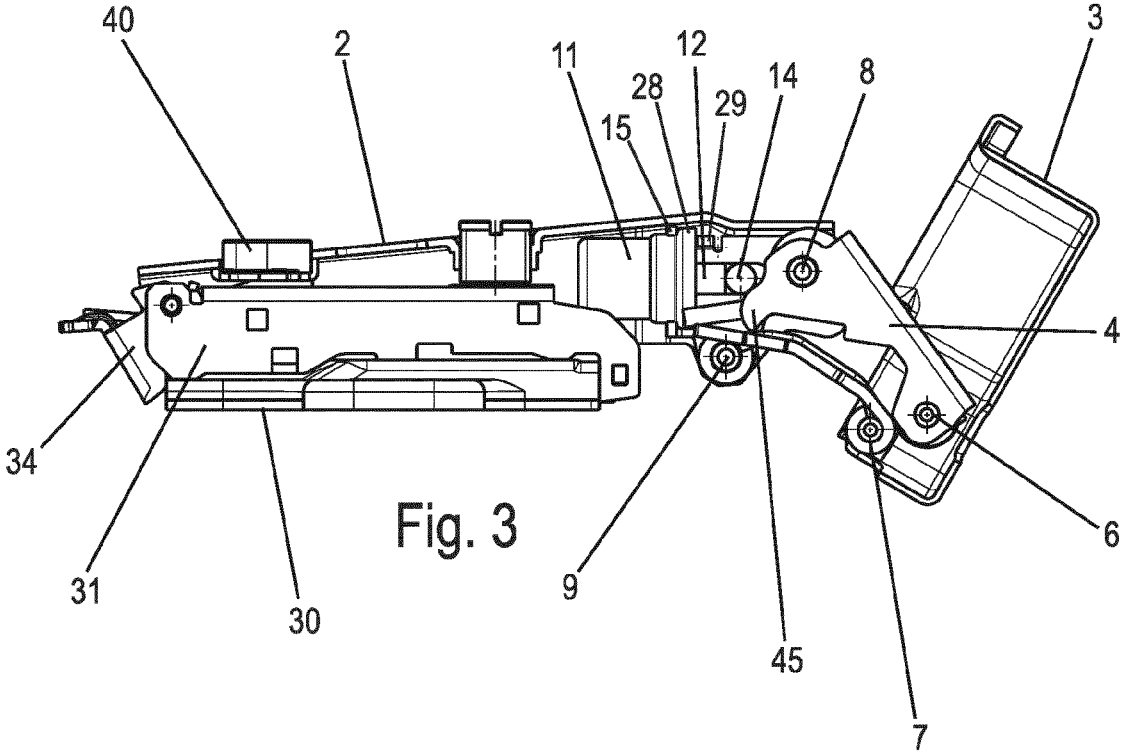
FIGS. 3 and 4 show two views of the hinge of FIG. 2 in middle opening positions.
Figure 4:
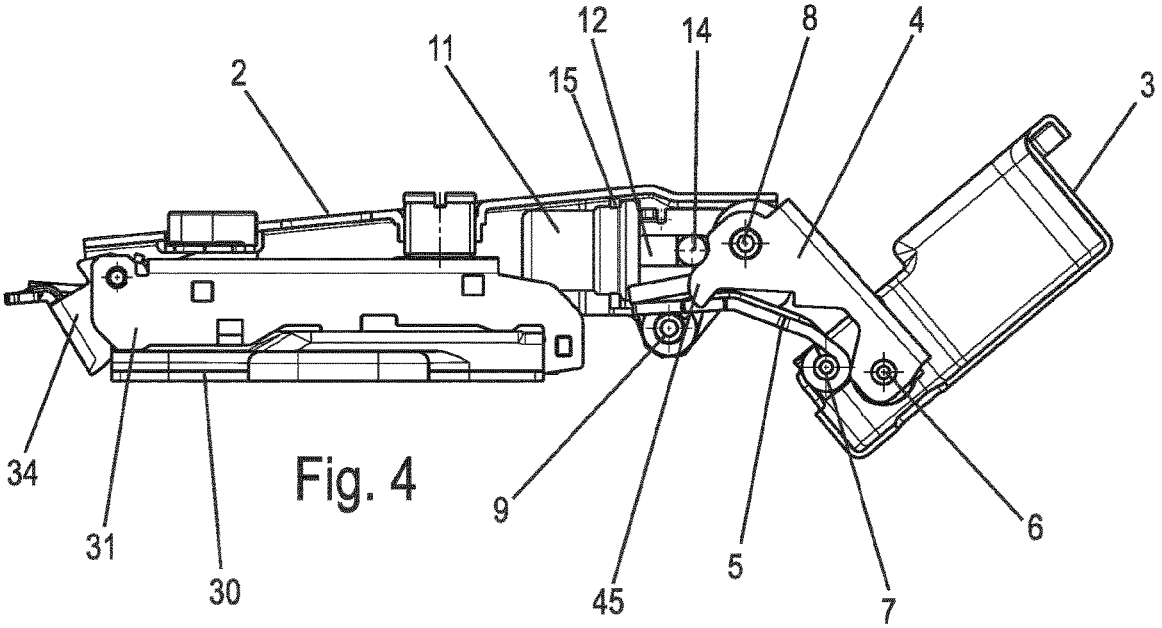
Figure 5:
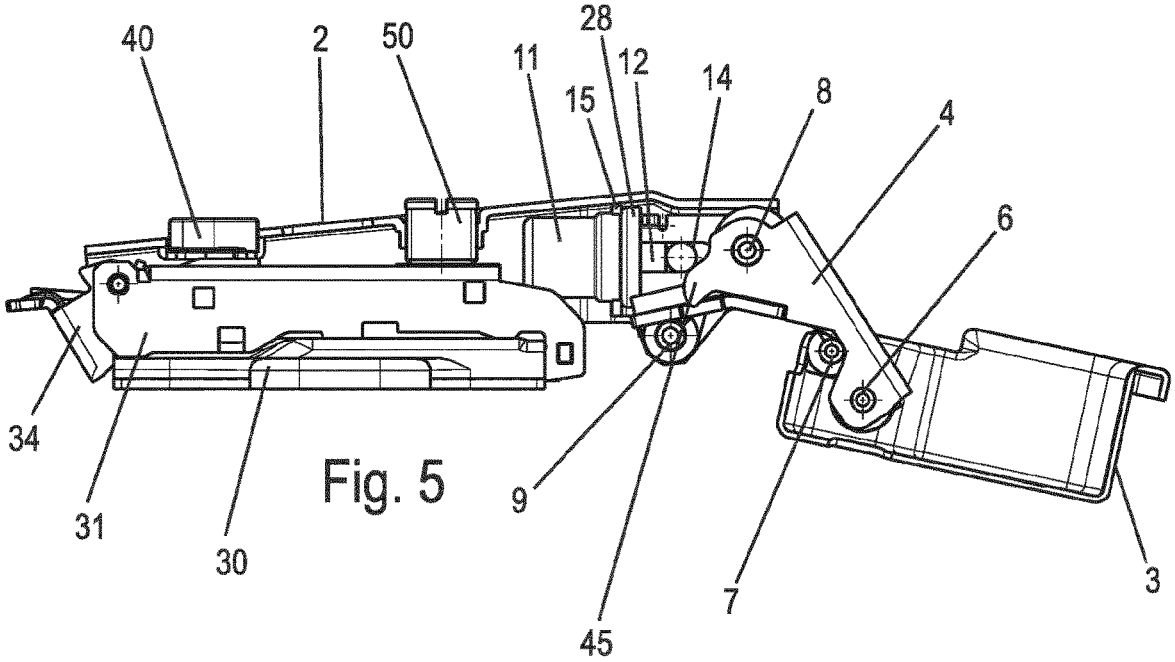
FIG. 5 shows a view of the hinge of FIG. 2 in a maximally open position.

The hinge 1 is shown in an assembled position in FIG. 2, wherein the hinge part 3 is located in a closed position. If the hinge part 3 is now pivoted in the opening direction, as shown in FIG. 3, the levers 4 and 5 also pivot. By pivoting the lever 4, the control curve 45 is rotated around the axis 8, whereby the pin 14 slides along the control curve 45. During a movement in the opening direction, the longitudinal extension of the linear damper 10 is increased, and the piston rod 12 extends out of the housing 11.

a middle open position is shown in FIG. 4, in an angle range between 40° and 65°, in which the linear damper experiences its maximum longitudinal extension. The pin 14 presses against the control curve 45 in a receptacle, and the piston rod 12 is located in the maximally extended position. If the hinge part 3 now moves farther in the opening direction, the lever 4 pivots in the opposing direction again and the pin 14 slides back along the control curve 45 again. The linear damper is thus slightly compressed again by retraction of the piston rod 12 until the position shown in FIG. 5 is reached. It can be seen in this position how the lever 4 overlaps the lever 5 with its webs 44. In the maximally open position, the linear damper also has a significantly longer longitudinal extension than in the closed position. Other control curves 45 can also be used for controlling the linear damper, for example, in the maximally open position, the linear damper 10 can also be retracted more strongly, in particular if a stronger opening damping is to be effectuated shortly before reaching the maximally open position. The control curve can also be designed so that the piston rod is retracted in the maximally open position, but the stroke of the piston rod over the angle range from the maximum longitudinal extension of the damper up to the maximally open position of the hinge part 3 is so small and/or the stroke movement of the piston rod 12 is so slow that almost no damping effect occurs. In any case, the linear damper passes through a maximum longitudinal extension during an opening movement of the hinge part 3. In the closing direction, the hinge part 3 is moved out of the position shown in FIG. 5 back into the position which is shown in FIG. 2, wherein then the linear damper also passes through a maximum longitudinal extension and is strongly compressed before reaching the closed position, which results in the required damping forces. Due to the interconnection of a pin 14 between the control curve 45 and the piston rod 12, lateral forces are avoided, since the pin 14 is linearly guided on the oblong hole 16 of the holder 15.

Figure 6:
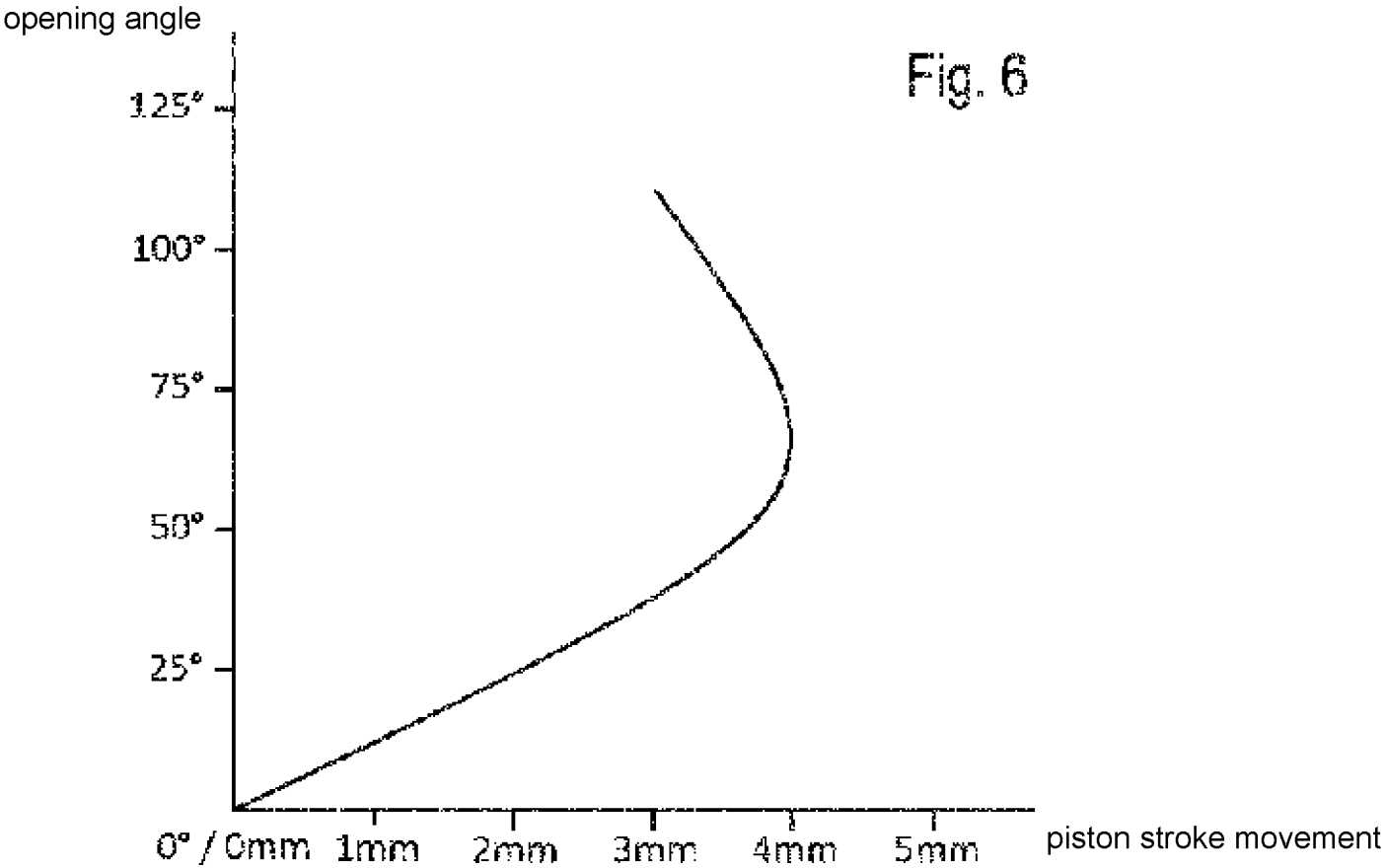
FIG. 6 shows a diagram to illustrate the longitudinal extension of the damper with respect to the open position of the hinge part.

A diagram is shown in FIG. 6, in which the position of the piston rod in relation to the opening angle of the hinge part 3 is shown. It can be seen that in the closed position, the piston rod 12 is in the retracted position and during an opening movement, the maximum longitudinal extension of the linear damper is in an angle range between 50 and 75°. If the hinge part 3 reaches a maximally open position of approximately 105°, the linear damper is slightly compressed again, wherein lesser or no damping forces can act on the hinge part 3 during the pivot movement up to the maximally open position. If the hinge part 3 is moved in the closing direction, the damping forces begin to act at an angle between 25 to 40° before the closed position, in order to decelerate the hinge part 3. However, the hinge part 3 is automatically moved into the closed position via the spring 60.

Figure 7:
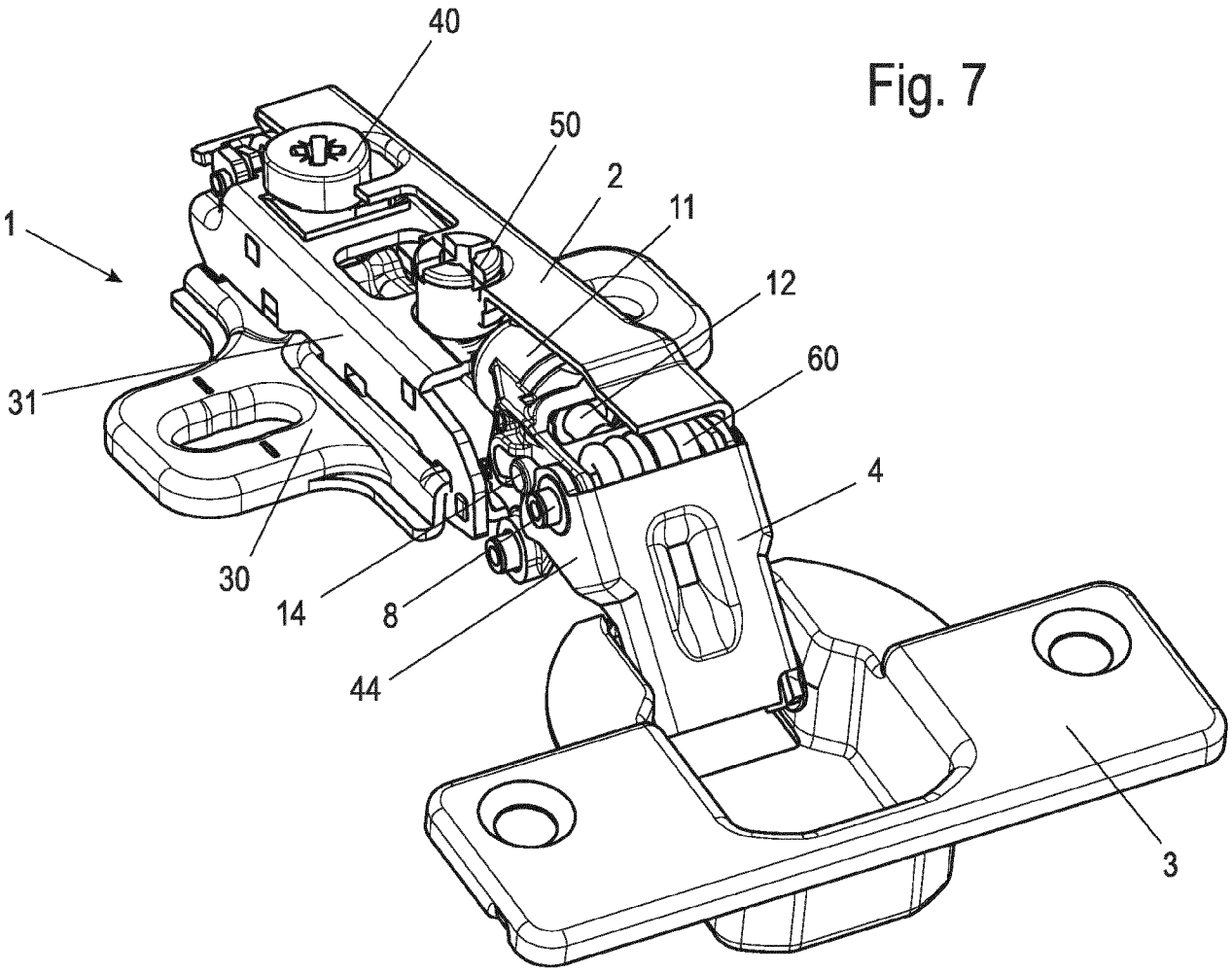
FIG. 7 shows a perspective view in partial section of the hinge of FIG. 1 in the installed position.

The hinge part 1 is shown once again in the installed position in FIG. 7, and it can be seen that the housing 11 of the linear damper is accommodated in the side part 2 and only occupies a small structural volume. The housing 11 is arranged in this case between the support adjustment unit 50 and the axes 8 and 9, wherein the extension of the linear damper in the longitudinal direction of the piston rod 12 is preferably less than 20 mm, in particular less than 18 mm. In spite of this small extension, sufficiently high damping forces can be provided.

Figure 8A:
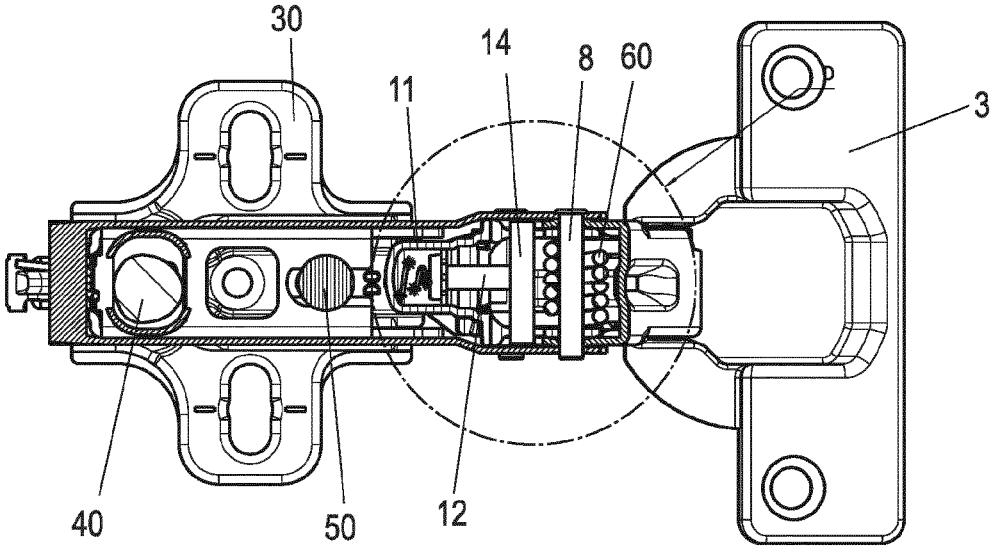
FIGS. 8A and 8B show two sectional views through the hinge of FIG. 7.
Figure 8B:
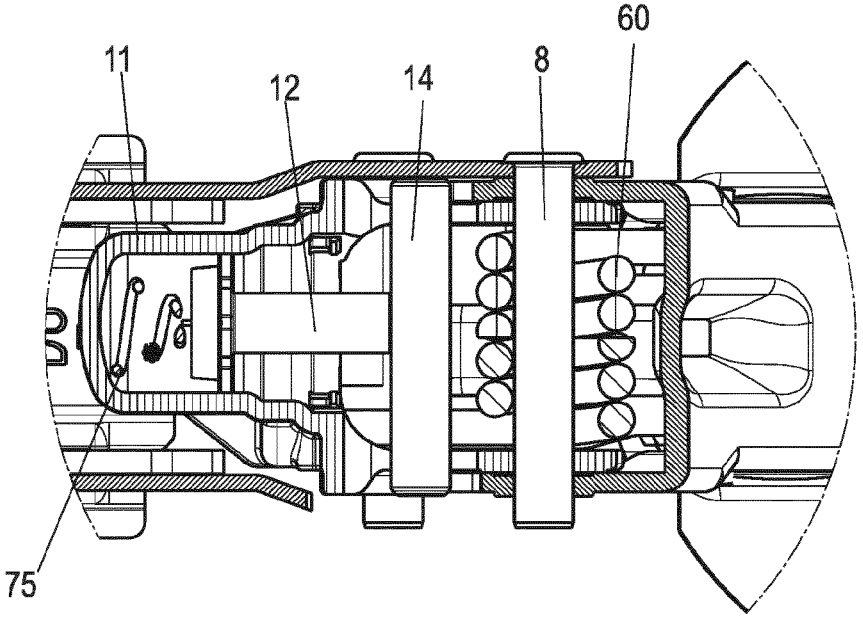
Figure 9A:
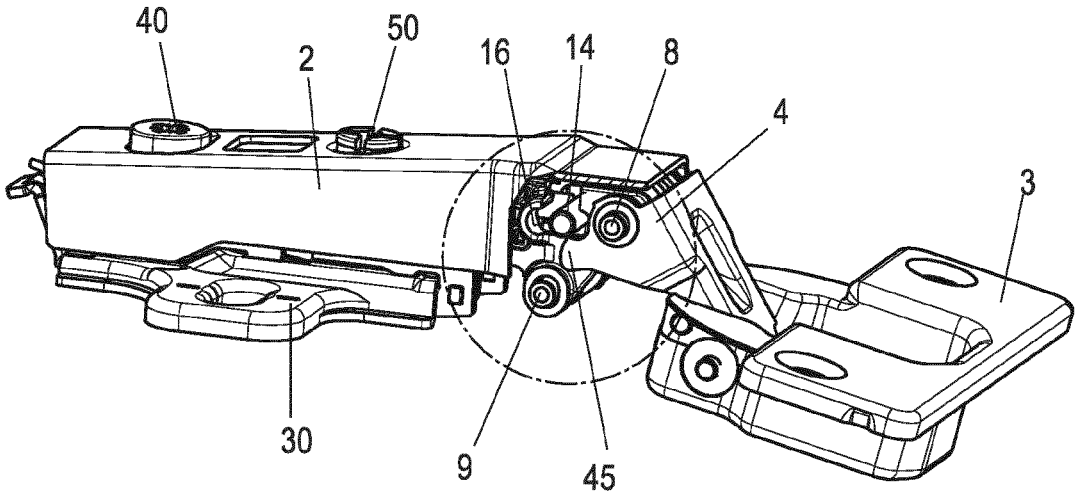
FIGS. 9A and 9B show two sectional views in the region of the end of the piston rod of the hinge.
Figure 9B:
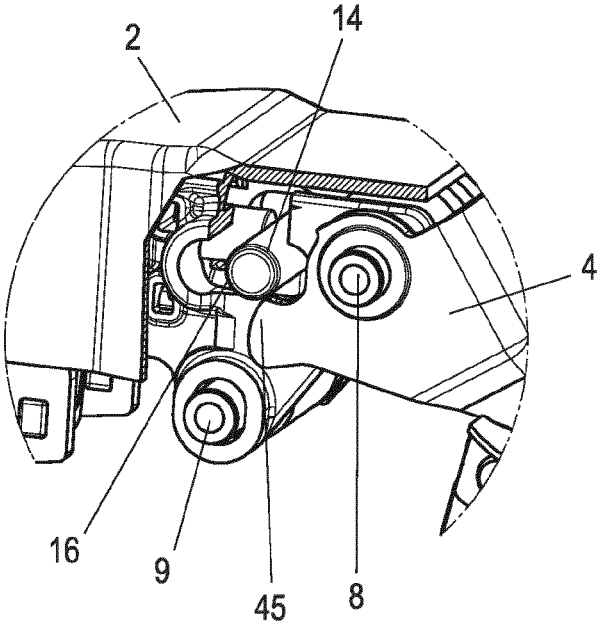

The drive mechanism for moving the piston rod 12 is illustrated in FIGS. 8A and 8B. The piston rod 12 is driven by the pin 14, which presses against an end face of the piston rod 12 and is aligned perpendicularly to the piston rod 12. The pin 14 is guided in this case to the oblong hole 16 in the holder 15 and can press the piston rod 12 into the cup-shaped housing 11 to generate damping forces. A spring 75 is supported in the housing 11 on the base, which spring pre-tensions a piston connected to the piston rod 12 in order to move the piston rod 12 into the extended position. Throttle elements can be provided on the piston, which obstruct a retraction movement into the housing 11 and facilitate a withdrawal of the piston rod, so that the damping effect only occurs in one direction. The guiding of the pin 14 along the oblong hole 16 is also shown in FIGS. 9A and 9B.

Figure 10A:
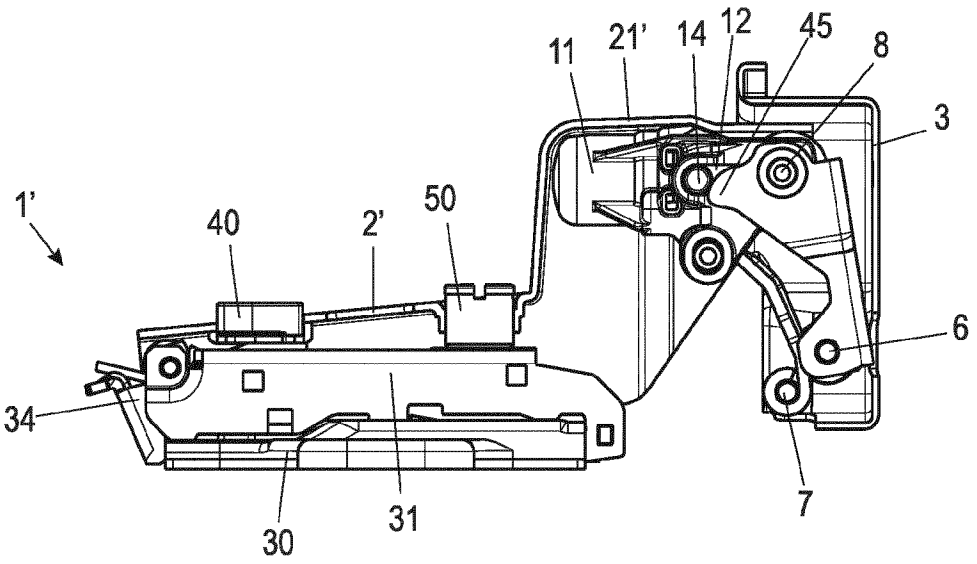
FIGS. 10A and 10B show two views of a modified exemplary embodiment of a hinge.
Figure 10B:
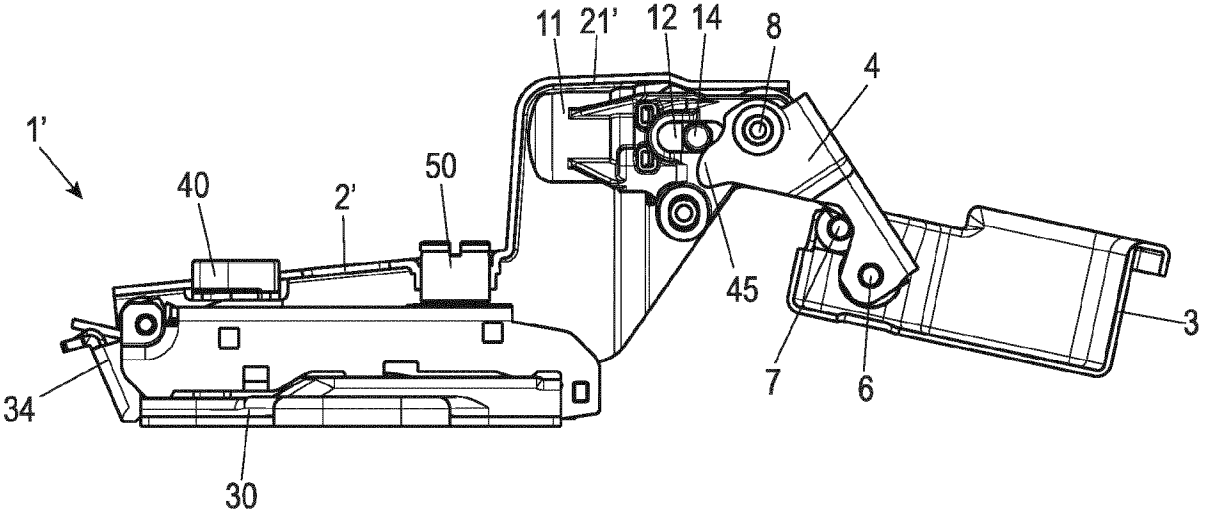

A modified hinge 1' is shown in FIGS. 10A and 10B, which is formed bent over and comprises a side part 2' for this purpose, which is held using a first section as in the preceding exemplary embodiment on the installation plate 30 and the holding element 31. A second section of the side part 2' is formed stepped and comprises a wall section 21', which protrudes beyond the support adjustment unit 50 and the depth adjustment unit 40. The two levers 4 and 5, on which the hinge part 3 is pivotably held, are fixed on this section 21'. In this case, the linear damper is also arranged having the housing 11 in the section 21' of the side part 2'. It can be seen that the complete unit made of linear damper 10 and the levers 4 and 5 can be used for completely different shapes of the side part 2', without the linear damper and the drive mechanism having to be changed for every shape of the side part 2'. The unit made of linear damper 10 and levers 4 and 5 with the hinge part 3 can thus be used for different hinge types.

LIST OF REFERENCE NUMERALS

1, 1' hinge
2, 2' side part
3 hinge part
4 lever
5 lever
6 axis
7 axis
8 axis
9 axis
10 linear damper
11 housing
12 piston rod
13 piston
14 pin
15 holder
16 oblong hole
17 opening
18 opening
19 opening
20 leg
21 connecting web
21' wall section
22 opening
23 opening
24 aperture
25 threaded borehole
28 step
29 tab
30 installation plate
31 holding element
32 axis
33 spring
34 catch element
35 opening
36 opening
40 depth adjustment unit
41 pin
44 web
45 control curve
47 opening
50 support adjustment unit
51 guide groove
52 thread
55 web
56 eye
60 spring
61 spring arm
62 spring arm
63 receptacle
75 spring

What is claimed is:

1. A hinge (1) having a side part (2) fixable on a wall and a hinge part (3), which is pivotable in relation to the side part (2) and is fixable on a door, wherein two levers (4, 5), which are each rotatably mounted on the side part (2) and on the hinge part (3), are provided between the side part (2) and the hinge part (3), and a linear damper (10) arranged in the side part (2), the linear damper having a housing (11) and a piston rod (12), wherein a control curve (45) is formed on one of the levers (4), which control curve compresses the linear damper (10) during a closing movement of the hinge part (3), wherein the housing (11) of the linear damper is immovably fixed in the side part (2) and the piston rod (12) is movable by the control curve (45), wherein a holder (15), in or on which the cup-shaped housing (11) of the damper (10) is inserted, is fixed in the side part (2).

2. The hinge according to claim 1, wherein the control curve compresses the linear damper (10) during a closing movement of the hinge part before reaching a closed position and during an opening movement of the hinge part before reaching the maximally open position.

3. A method for opening and closing a hinge (1) according to claim 2, wherein the linear damper (10) experiences a maximum longitudinal extension during an opening movement of the hinge part up to the maximally open position and also experiences a maximum longitudinal extension during a closing movement of the hinge part from the maximally open position up into the closed position.

4. The hinge according to claim 1 wherein the linear damper (10) has a greatest extension in the longitudinal direction in an angle range of the hinge part between 30° to 110° from the closed position.

5. The hinge according to claim 1, wherein the linear damper (10) is fixed on the side part (2) via a holder (15).

6. The hinge according to claim 1, wherein the housing (11) of the linear damper (10) is fixed in a non-rotatable manner on the side part (2).

7. The hinge according to claim 1, wherein the control curve (45) is integrally formed with the lever (4).

8. The hinge according to claim 1, wherein the linear damper (10) comprises a piston rod (12), to which a spring (75) is applied indirectly or directly, so that the piston rod extends automatically.

9. The hinge according to claim 8, wherein the piston rod (12) is pressed indirectly or directly in a direction of the fixed damper housing (11) by the control curve (45) during a closing and opening movement.

10. The hinge according to claim 8, wherein the stroke movement of the piston rod (12) is in a range between 2 mm and 6 mm.

11. The hinge according to claim 1, wherein the holder (15) is held by means of at least one axis (8, 9) of the levers (4, 5), on the side part (2).

12. A hinge (1) having a side part (2) fixable on a wall and a hinge part (3), which is pivotable in relation to the side part (2) and is fixable on a door, wherein two levers (4, 5), which are each rotatably mounted on the side part (2) and on the hinge part (3), are provided between the side part (2) and the hinge part (3), and a linear damper (10) arranged in the side part (2), the linear damper having a housing (11) and a piston rod (12), wherein a control curve (45) is formed on one of the levers (4), which control curve compresses the linear damper (10) during a closing movement of the hinge part (3), wherein the housing (11) of the linear damper is immovably fixed in the side part (2) and the piston rod (12) is movable by the control curve (45), wherein the control curve (45) is formed on at least one curved web (44), and slides along a pin (14), which is operationally connected to the linear damper (10), and wherein one of the levers (4) is formed U-shaped and comprises two control curves (45), against which the pin (14) presses.

13. The hinge according to claim 12, wherein the pin (14) is linearly guided on a holder (15) or the side part (2).

14. The hinge according to claim 12, wherein the control curves (45) are formed on the U-shaped lever (4), which overlaps the other lever (5) at least in one position of the hinge part (3).

15. A hinge (1) having a side part (2) fixable on a wall and a hinge part (3), which is pivotable in relation to the side part (2) and is fixable on a door, wherein two levers (4, 5), which are each rotatably mounted on the side part (2) and on the hinge part (3), are provided between the side part (2) and the hinge part (3), and a linear damper (10) arranged in the side part (2), the linear damper having a housing (11) and a piston rod (12), wherein a control curve (45) is formed on one of the levers (4), which control curve compresses the linear damper (10) during a closing movement of the hinge part (3), wherein the housing (11) of the linear damper is immovably fixed in the side part (2) and the piston rod (12) is movable by the control curve (45), wherein a holder (15), on which the cup-shaped housing (11) of the damper (10) is formed, is fixed in the side part (2).

16. A hinge (1) having a side part (2) fixable on a wall and a hinge part (3), which is pivotable in relation to the side part (2) and is fixable on a door, wherein two levers (4, 5), which are each rotatably mounted on the side part (2) and on the hinge part (3), are provided between the side part (2) and the hinge part (3), and a linear damper (10) arranged in the side part (2), the linear damper having a housing (11) and a piston rod (12), wherein a control curve (45) is formed on one of the levers (4), which control curve compresses the linear damper (10) during a closing movement of the hinge part (3), wherein the housing (11) of the linear damper is immovably fixed in the side part (2) and the piston rod (12) is movable by the control curve (45), wherein the side part (2) is held adjustably on an installation plate (30) and a holding element (31), wherein a support adjustment unit (50) and a depth adjustment unit (40) are provided.

17. The hinge according to claim 16, wherein a holder (15) is arranged with the linear damper (10) between the lever (4) and the support adjustment unit (50).

18. A hinge (1) having a side part (2) fixable on a wall and a hinge part (3), which is pivotable in relation to the side part (2) and is fixable on a door, wherein two levers (4, 5), which are each rotatably mounted on the side part (2) and on the hinge part (3), are provided between the side part (2) and the hinge part (3), and a linear damper (10) arranged in the side part (2), the linear damper having a housing (11) and a piston rod (12), wherein a control curve (45) is formed on one of the levers (4), which control curve compresses the linear damper (10) during a closing movement of the hinge part (3), wherein the housing (11) of the linear damper is immovably fixed in the side part (2) and the piston rod (12) is movable by the control curve (45), wherein a spring (60) is provided for pre-tensioning the hinge part (3) in a closing region in the closing direction.

* * * * *